US011148008B1

(12) United States Patent
O'Neill

(10) Patent No.: US 11,148,008 B1
(45) Date of Patent: Oct. 19, 2021

(54) SELF-RESCUE SWIM FIN BELT

(71) Applicant: Charles Ryan O'Neill, Honolulu, HI (US)

(72) Inventor: Charles Ryan O'Neill, Honolulu, HI (US)

( * ) Notice: Subject to any disclaimer, the term of this patent is extended or adjusted under 35 U.S.C. 154(b) by 0 days.

(21) Appl. No.: 17/302,543

(22) Filed: May 5, 2021

Related U.S. Application Data

(60) Provisional application No. 62/704,405, filed on May 8, 2020.

(51) Int. Cl.
*A63B 31/11* (2006.01)

(52) U.S. Cl.
CPC ..... *A63B 31/11* (2013.01); *A63B 2210/50* (2013.01); *A63B 2225/09* (2013.01)

(58) Field of Classification Search
CPC .. A63B 31/11; A63B 2210/50; A63B 2225/09
See application file for complete search history.

(56) References Cited

U.S. PATENT DOCUMENTS

| | | | | |
|---|---|---|---|---|
| 2,980,926 A | | 4/1961 | Wolshin | |
| 4,017,925 A | * | 4/1977 | Shamlian | A63B 31/11 441/64 |
| 4,250,584 A | * | 2/1981 | Korn | A63B 31/11 441/61 |
| 4,251,894 A | * | 2/1981 | Hollingsworth | A63B 31/11 441/64 |
| 4,599,071 A | * | 7/1986 | Juang | A63B 31/11 441/61 |
| 5,242,321 A | | 9/1993 | Gil | |
| 2009/0137166 A1 | * | 5/2009 | Melius | A63B 31/11 441/64 |
| 2016/0023053 A1 | | 1/2016 | Szymanski | |
| 2017/0156435 A1 | * | 6/2017 | Al Nawab | A41F 9/002 |

FOREIGN PATENT DOCUMENTS

| | | |
|---|---|---|
| WO | WO2008/102386 A1 | 8/2008 |
| WO | WO2012/160946 A1 | 11/2012 |

* cited by examiner

*Primary Examiner* — Stephen P Avila
(74) *Attorney, Agent, or Firm* — Seth M. Reiss

(57) ABSTRACT

In one aspect, the invention provides a swim fin comprising a foldable fin blade and foot enclosure, and means for releasably securing the foot of a user within said foot enclosure when in use for swimming. When not in use for swimming, the fin is collapsed to demonstrate a substantially flat form and releasably interconnected with another such swim fin to form a loop structure that can be worn as a belt or bandolier, or stored flat and carried within a fanny pack. The combination swim fin belt apparatus allows a user to carry a pair of swim fins conveniently, comfortably and unobtrusively while engaging in activities that take place on or near the water. The fins are thus immediately available to be deployed for swimming, in particular when the user unexpectedly needs to swim long distances or in challenging conditions without the aid of water safety devices.

20 Claims, 13 Drawing Sheets

SELF-RESCUE SWIM FIN BELT

CROSS-REFERENCE TO RELATED APPLICATIONS

This patent application claims the benefit of U.S. Provisional Patent Application No. 62/704,405 filed May 8, 2020, by the present inventor, the contents of which are incorporated herein in their entirety.

STATEMENT REGARDING FEDERALLY SPONSORED RESEARCH

The invention described herein was not made pursuant to a government agency grant or contract. No government funds were utilized in the described invention.

TECHNICAL FIELD OF THE INVENTION

The invention relates to water activity safety equipment. More particularly, the invention describes swim fins configured to be made into an accessory such as a belt and deployed for immediate use.

BACKGROUND

Swim fins are well known in the water sports industry and come in many shapes and sizes, for example, extended length fins designed for power and speed, and short rigid swim fins useful for body surfing. Swim fins facilitate and enhance a swimmer's ability to swim, swim fast, swim with less effort, and swim longer distances without tiring or needing buoyancy aids.

Swim fins are typically made available in the same shape and form as they are used. These are quite unwieldy to carry and take up unnecessary space in storage. Thus, in many instances, even though availability of swim fins would prove vital for survival, they are not readily available for use as they awkward and burdensome to carry.

For example, when a swimmer is stranded in a large body of water, such as a lake, sea or ocean, having access to swim fins can make the difference between surviving or drowning. Thus, there is a dire need for swim fins that are extremely portable, convenient and easy to carry and deploy motivating those whose activities are located on or near large bodies of water to carry a pair of such swim fins.

An object of the subject invention is to provide for swim fins that are extremely portable, convenient and easy to carry.

A further object of the subject invention is to provide for swim fins that can be conveniently, inconspicuously and unobtrusively worn while participating in water sports activities or other activities where there is some risk of having to swim a considerable distance to safety.

A further object of the subject invention is to provide for swim fins that can be stored in compact form taking up a minimum of space and, therefore, more likely to be included in water rescue equipment.

A further object of the subject invention is to provide for swim fins that are immediately available for use in the event there in an unanticipated need to swim a long distance or to swim in challenging conditions.

A further object of the subject invention is to provide for sustainable swim fins made entirely of recycled materials.

BRIEF DESCRIPTION OF THE INVENTION

These and other objects are achieved in the subject invention, a self-rescue swim fin belt comprising a pair of swim fins each of which is collapsible into an elongated belt form having ends that releasably connect to one another to form a continuous belt that can be worn around one's waist or other body part, or stored flat within a fanny pack, and immediately available for deployment for use to aid swimming.

One aspect of the present invention is to provide swim fins that can conveniently, inconspicuously and unobtrusively be carried around the waist or shoulder during water related activities such as water sports, fishing and boating.

Another aspect of the present invention is to provide a swim fin that collapses into a compact elongated form and that connects to a second fin for ease of carrying and storage.

Yet another aspect of the present invention is to provide for swim fins that are extremely easy and convenient to transport so that they are more likely immediately available when needed for water safety and rescue.

Still a further aspect of the subject invention is to provide for swim fins that can be carried on one's body in a way that does not interfere with activities conducted on or near bodies of water.

DRAWINGS

These and other features, aspects, and advantages of the present invention will become better understood when the following detailed description is read with reference to the accompanying drawings in which like characters represent like parts throughout the drawings, wherein.

Figure 2A:
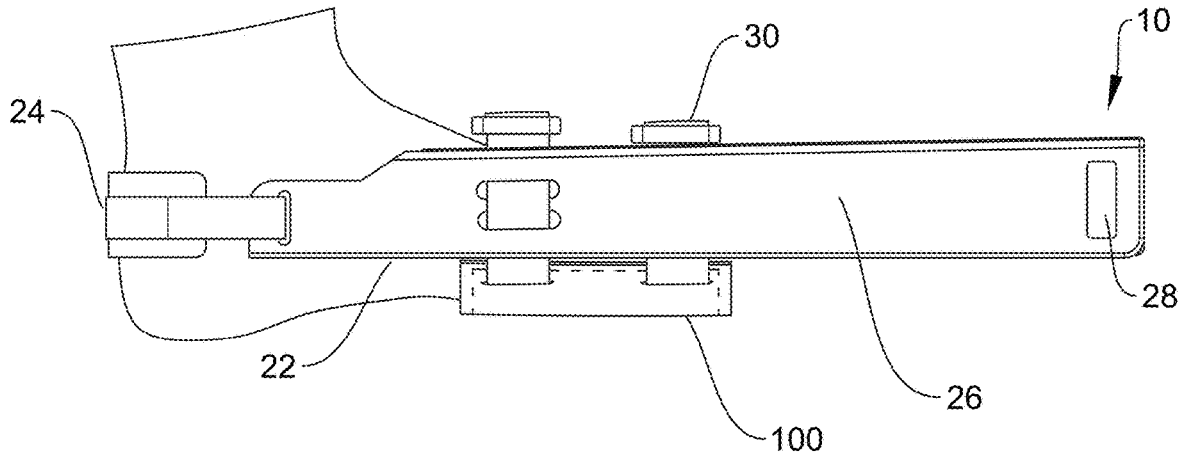
FIG. 2A is a side view of the swim fin 10 with a user's foot inside the foot hammock 100.
Figure 2B:
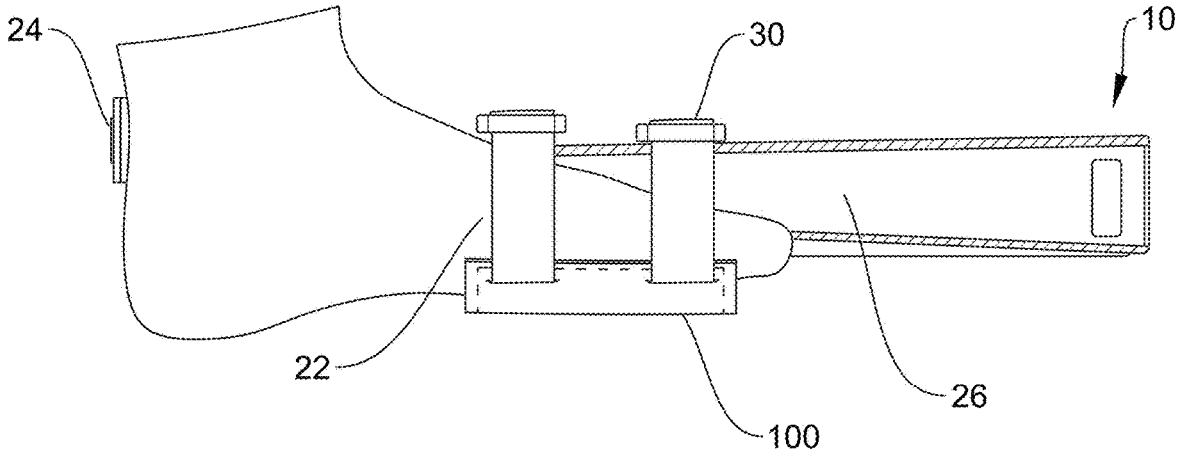
Figure 3A:
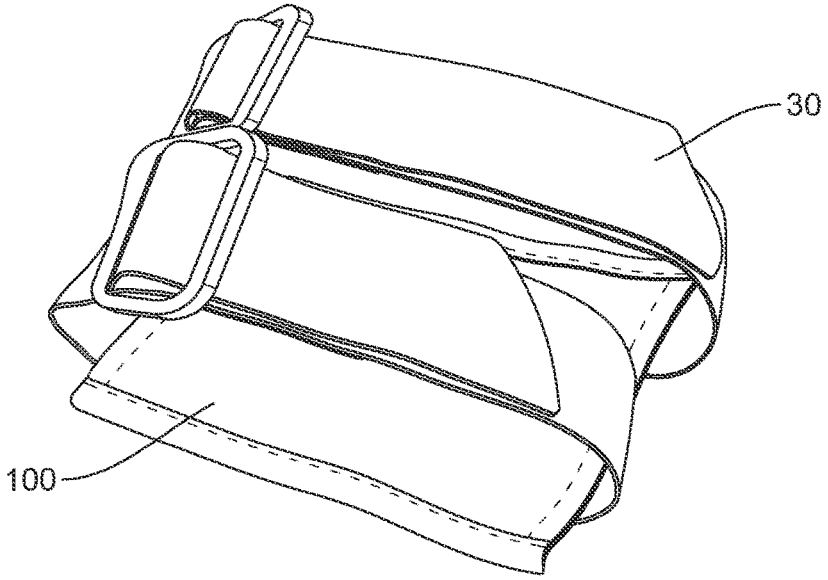
Figure 3B:
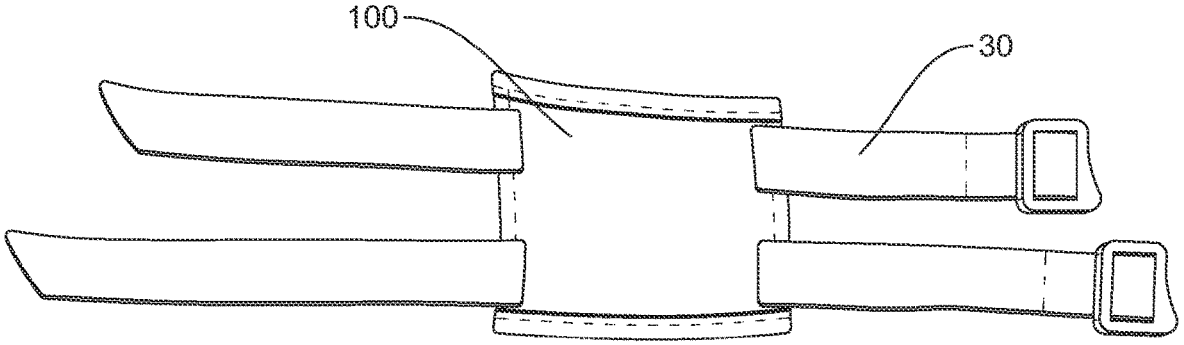
Figure 3C:
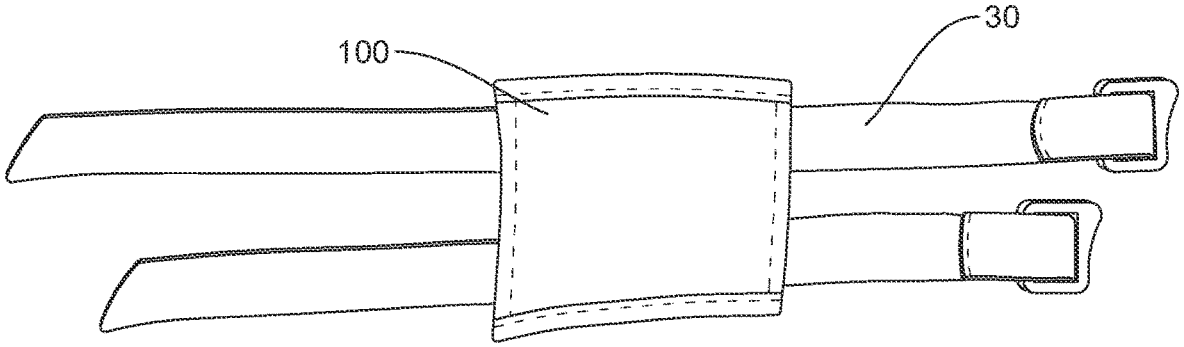
Figure 4:
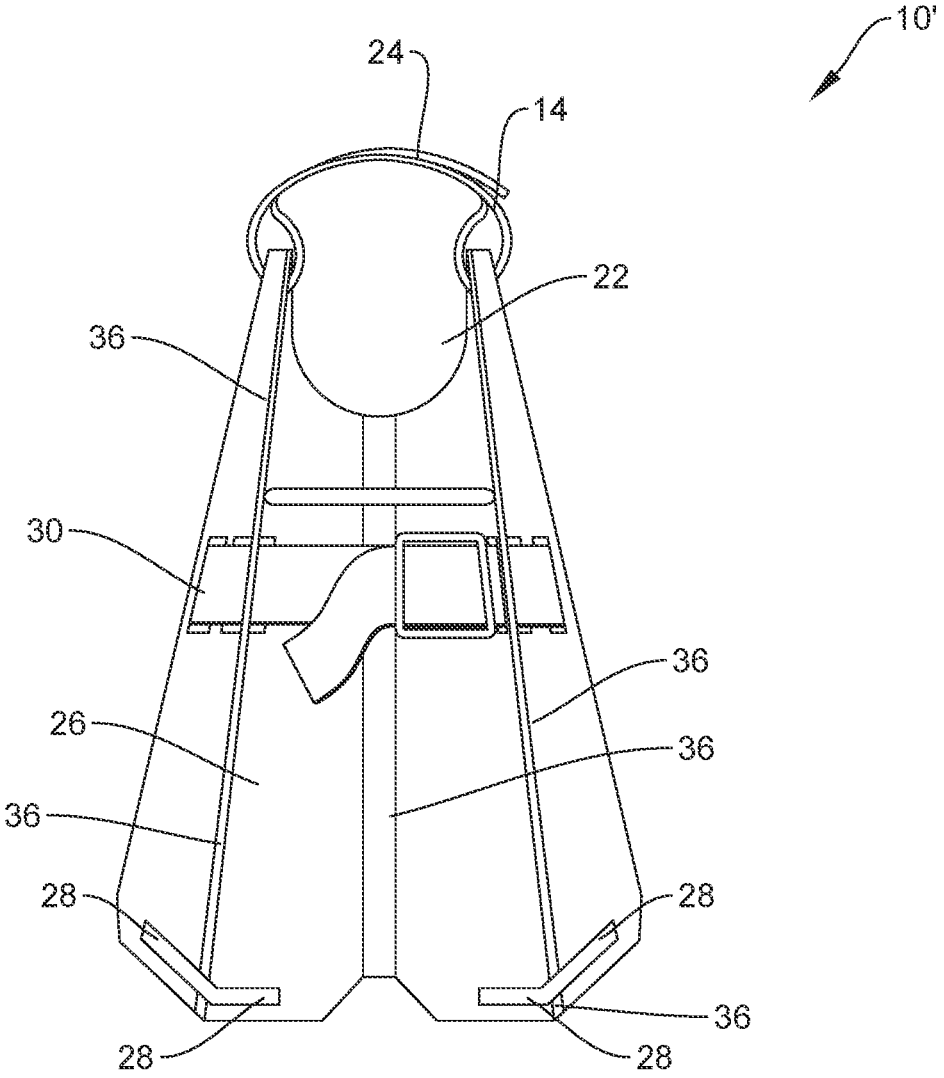
Figure 5:
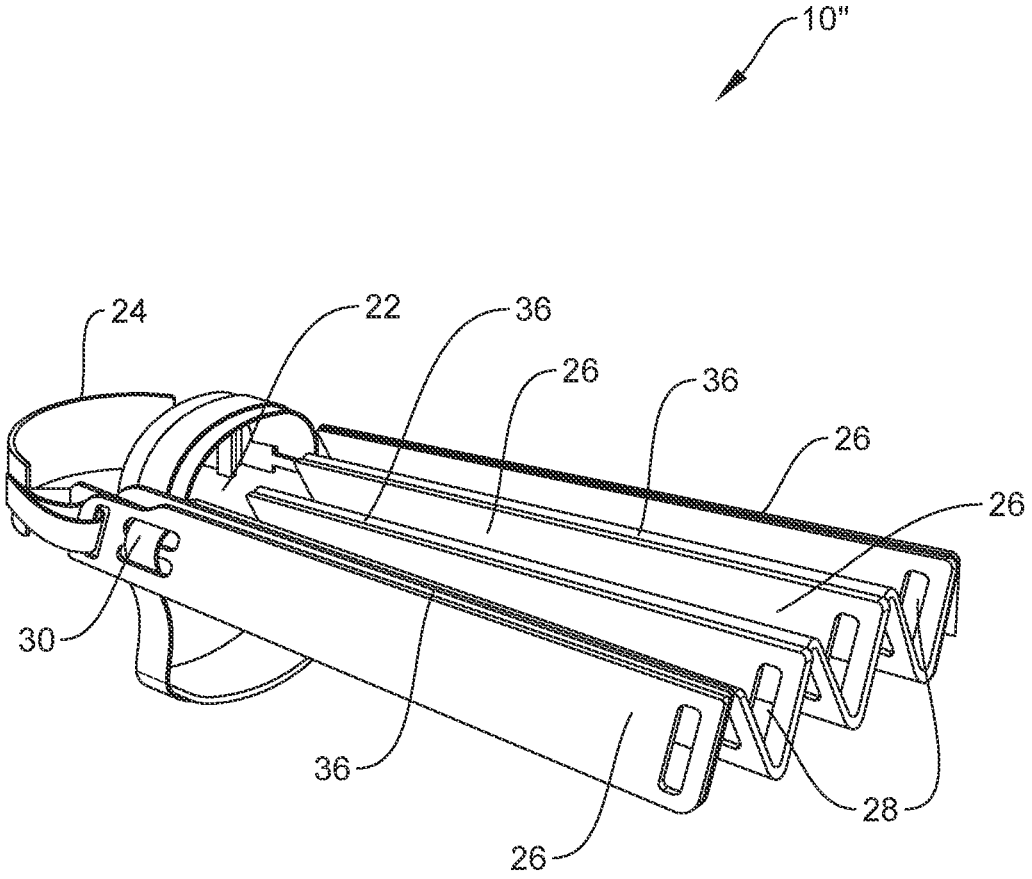
Figure 6A:
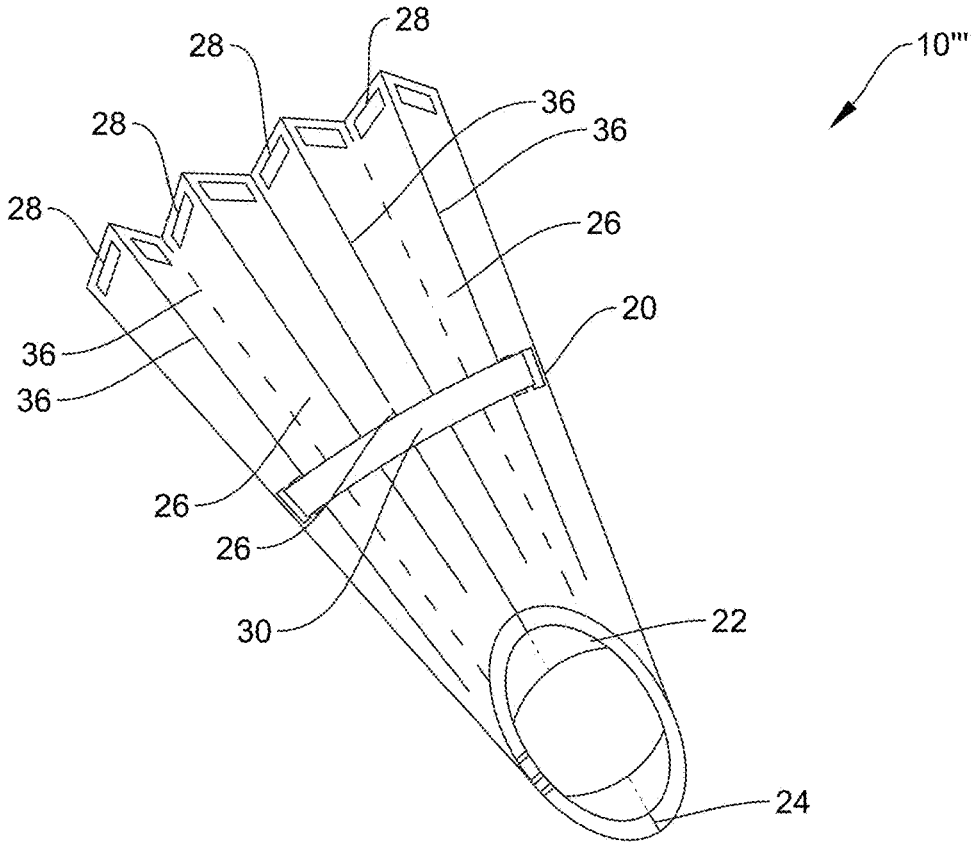
Figure 6B:
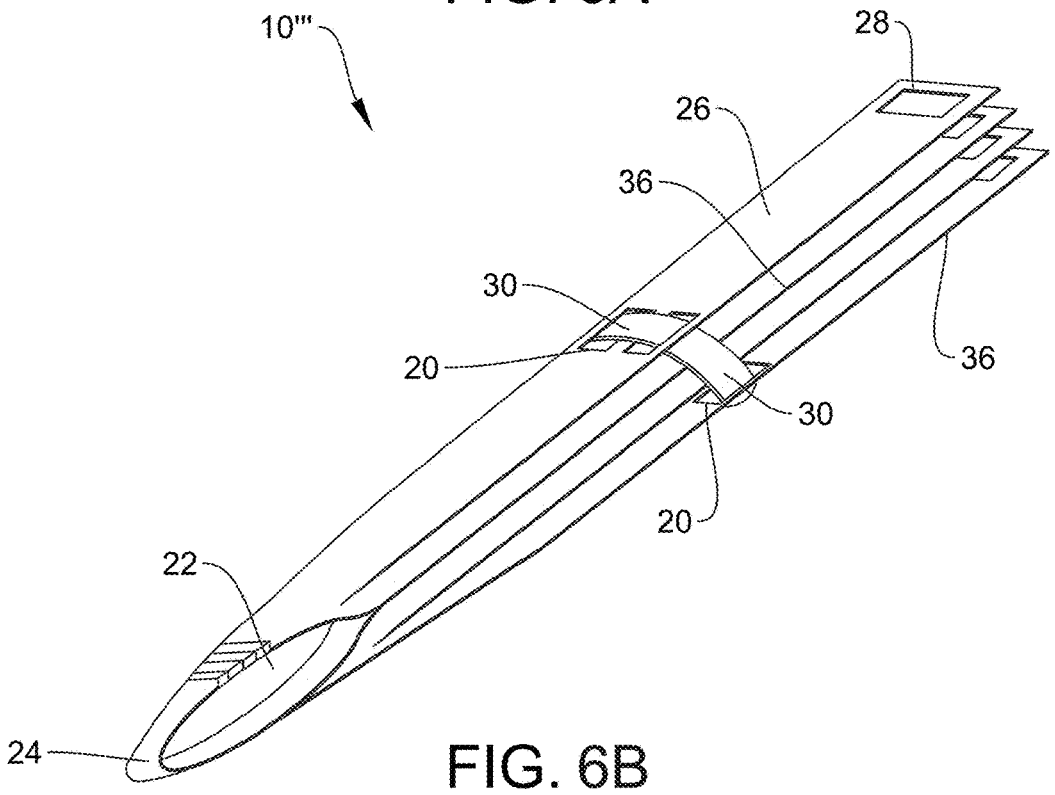
Figure 7A:
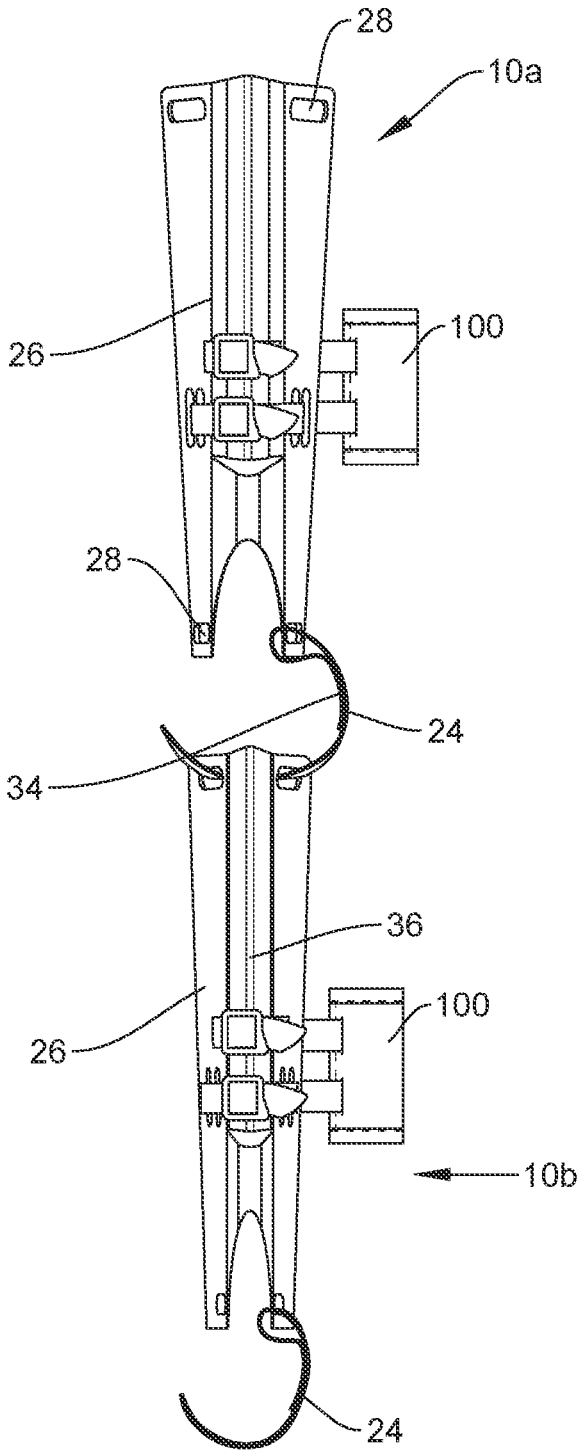
Figure 7B:
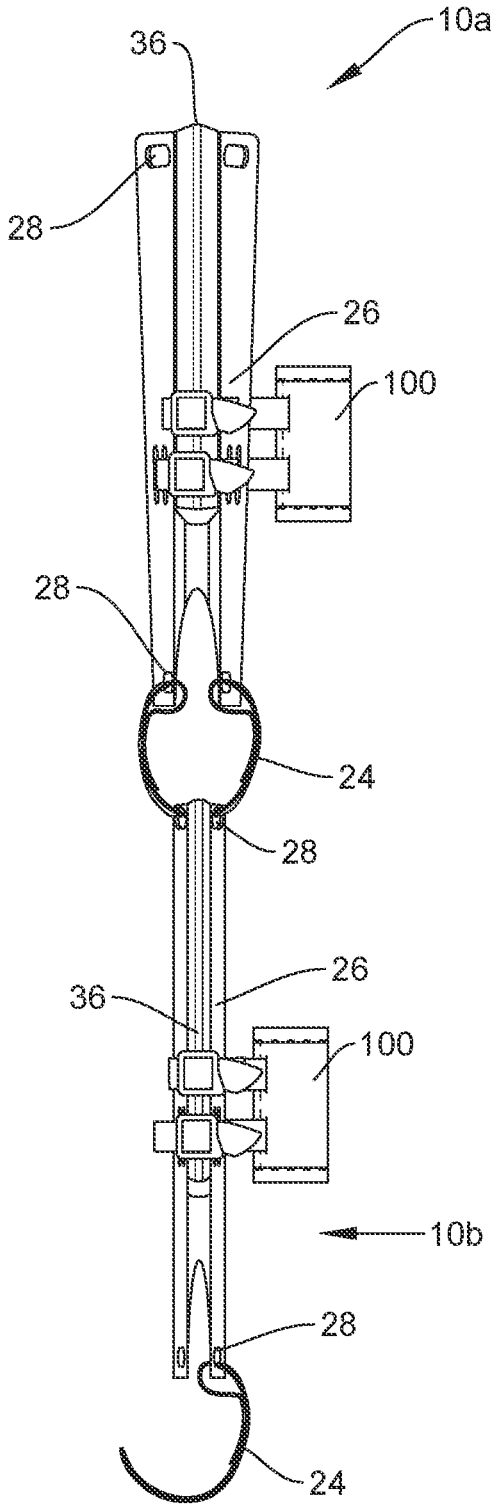
Figure 8:
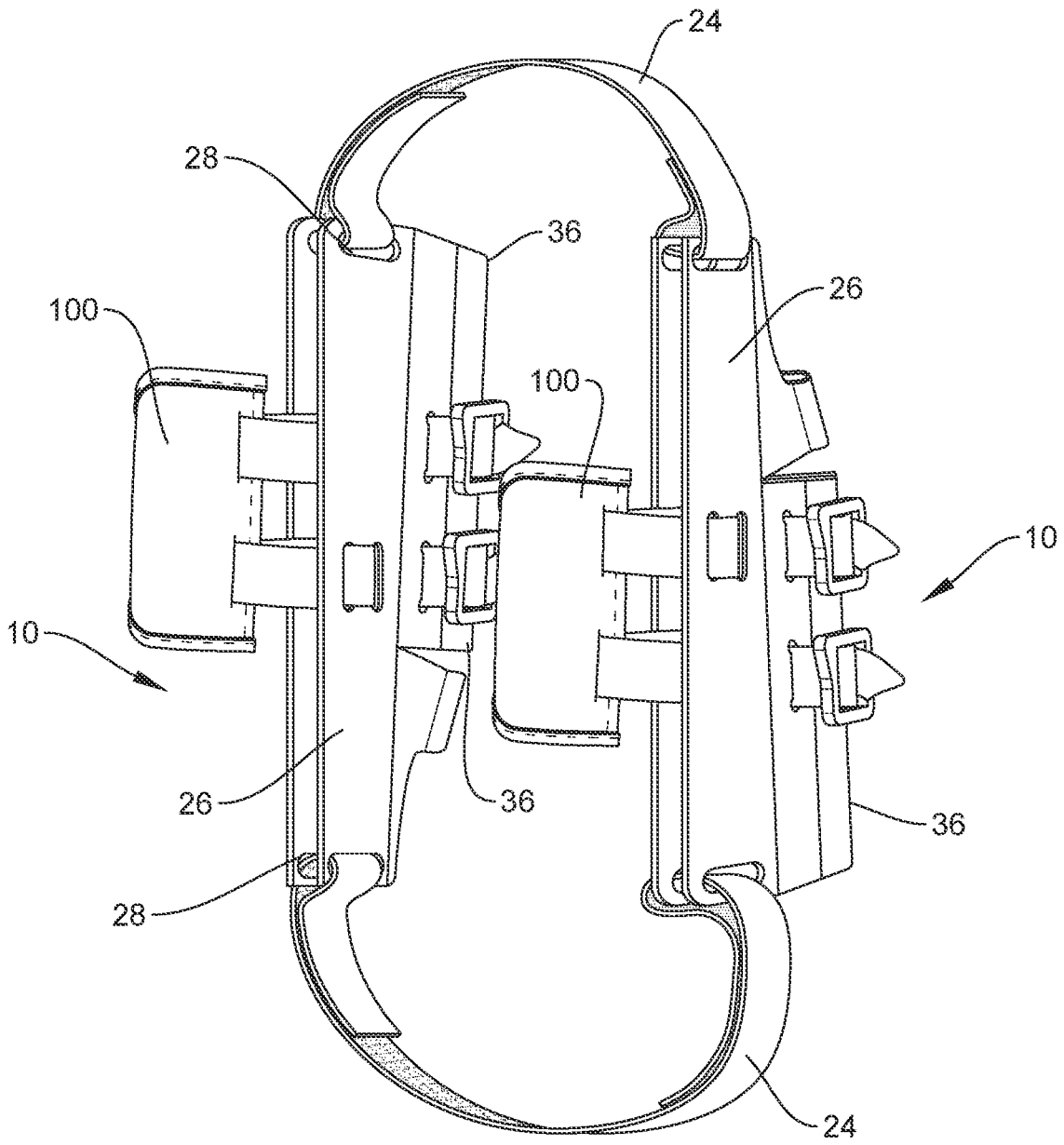
Figure 9:
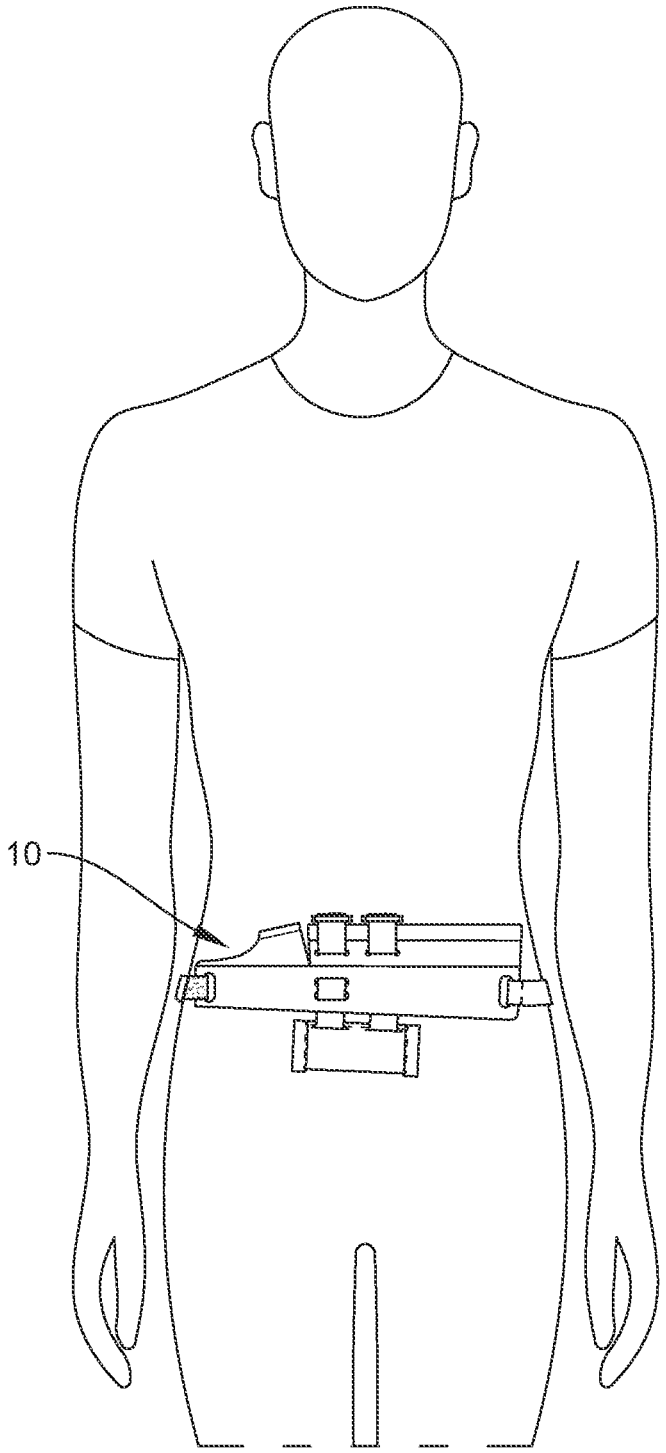
Figure 10:
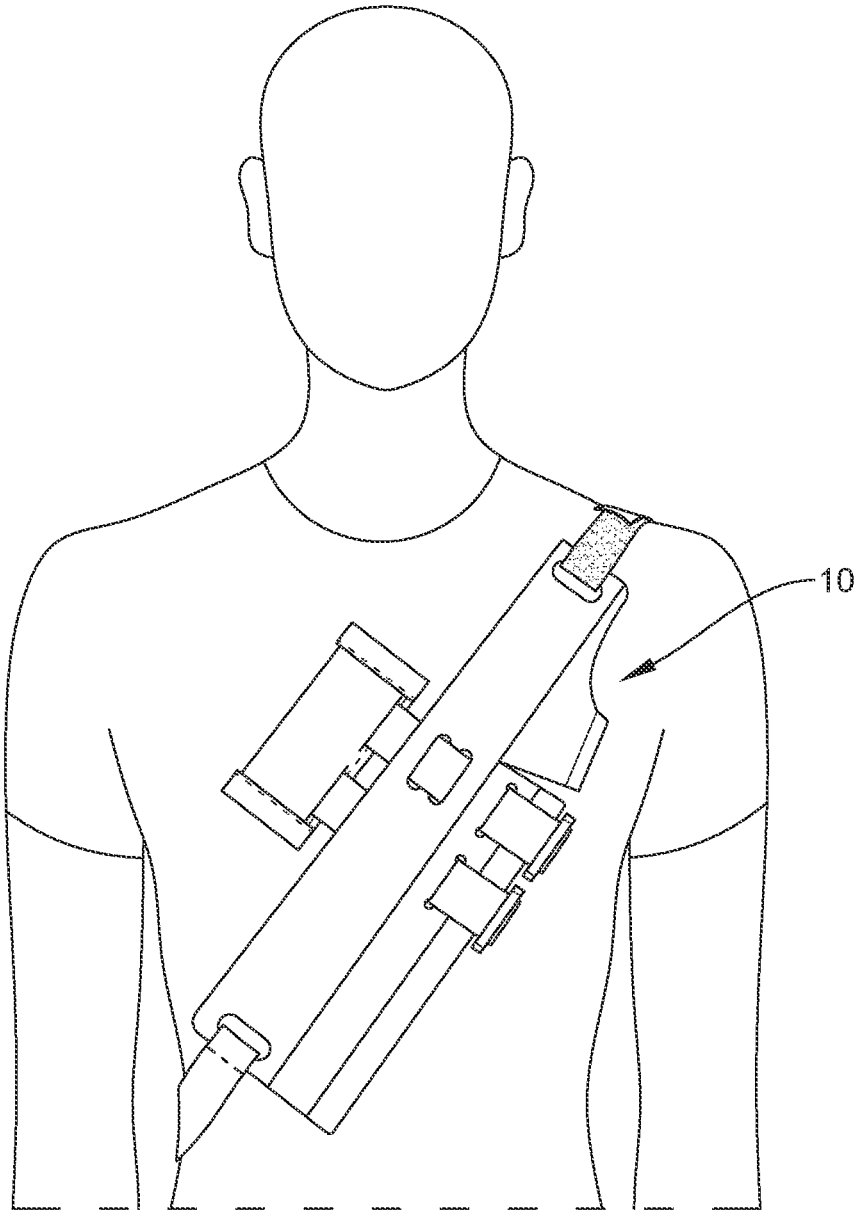

FIG. 2B is a side view of the swim fin 10 with part of the blade 26 cutaway to better illustrate foot hammock 100;

FIG. 3A is a top perspective view of the foot hammock 100;

FIG. 3B shows the foot hammock 100 from the bottom with the straps 30 fully opened;

FIG. 3C is a top view of the foot hammock 100 with the straps 30 fully opened;

FIG. 4 is a top perspective view of an alternate embodiment 10' of the swim fin of the present invention;

FIG. 5 is a side perspective view of yet another alternate embodiment of the swim fin of the present invention wherein alternative embodiment fin 10" comprises multiple pleats 26;

FIG. 6A is a top view of a further alternative embodiment fin 10''' in expanded state for use;

FIG. 6B shows alternative embodiment fin 10''' in fully folded state for storage and carriage;

FIG. 7A is a top view of two swim fins 10 of the invention in partially folded state and being attached to each other at just one end;

FIG. 7B is a top view of 2 swim fins 10 of the invention illustrated fins 10 in partially and fully folded states, attached to each other at just one end;

FIG. 8 is a top perspective view of 2 swim fins 10 of the invention in fully collapsed state attached to each other at both ends to form a looped structure;

FIG. 9 shows a user wearing the combination swim fin belt apparatus as a belt; and FIG. 10 shows a user wearing the combination swim fin belt apparatus as a bandoleer.

DETAILED DESCRIPTION

The definitions provided herein are to facilitate understanding of certain terms used frequently herein and are not meant to limit the scope of the present disclosure.

As used in this specification and the appended claims, the singular forms "a", "an", and "the" encompass embodiments having plural referents, unless the content clearly dictates otherwise.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the term "or" is generally employed in its sense including "and/or" unless the content clearly dictates otherwise.

As used in this specification and the appended claims, the terms "pleat" and "fold" are used interchangeably and each is intended to include the other, and also to include the term "hinge."

As noted herein, in one aspect the invention provides a swim fin and a fin belt. Described in some detail, with references to attached drawings, are exemplary embodiments of the swim fin and the fin belt comprising the swim fins.

Figure 1A:
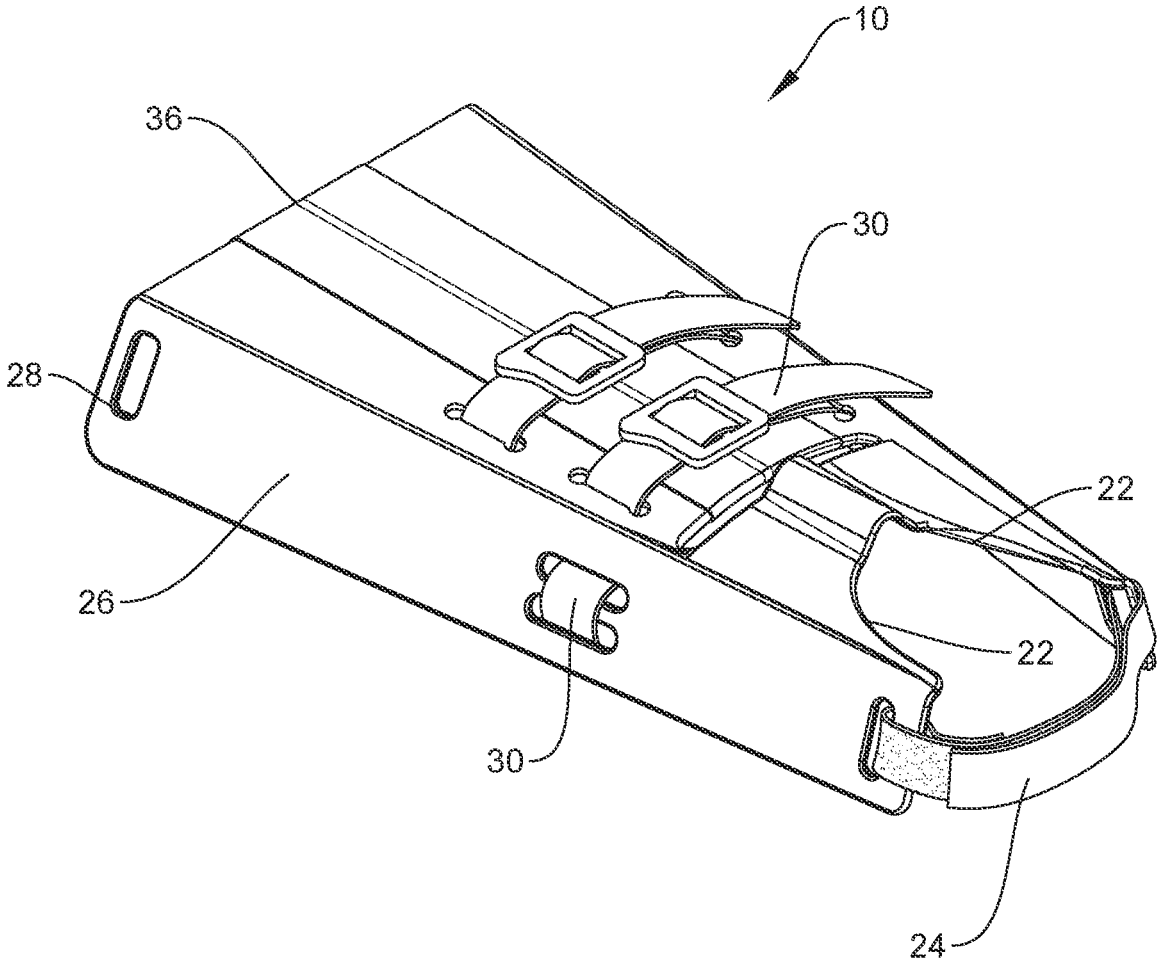
FIG. 1A is a top rear perspective view of a preferred embodiment of the swim fin the invention in open or deployed form.

In FIG. 1A a top rear perspective view of a preferred embodiment of the swim fin 10 of the present invention in open or deployed form is shown. Swim fin 10 is configured to demonstrate an open form when being used for swimming as shown in FIG. 1A, and that can be folded into a flattened collapsed state when not in use as will be described herein.

Swim fin 10 comprises a foot enclosure 22. A heal securement means 24 releasably secures the foot of a user within the foot enclosure 22 when fin 10 is in use for swimming According to the embodiment shown, securement means 24 comprises a length adjustable strap, wherein the length adjustability is imparted by means of at least one of, for example, but not limited to, a clip, buckle, interlocking fibers or combinations thereof. In one exemplary embodiment, the securement means includes a strap having interlocking fibers, such as for example Velcro®, on one side. The strap may be attached to one side of the fin while the other side has a buckle loop that can receive the strap through it such that the strap can fold back and attach itself to the interlocking fibers, thus rendering it length adjustable. The strap may further comprise padding along its inside (not shown) for comfort when the fin is being used. Such buckle-loop straps are well known in the art, and may be made of Nylon or such similar material. The padding may be made of any cushioning material, such as for example, Neoprene. Other such variations for the securement means will become apparent to one skilled in the art, and is contemplated to be within the scope of the invention.

The swim fin 10 further comprises a collapsible fin blade 26 extending out from said foot enclosure having a distal end farthest away from said foot enclosure. The fin blade 26 is rendered collapsible by means of a single pleat 36. Thus, the fin blade 26 is configured to demonstrate a substantially flat form when not being used for swimming by its ability to be folded along pleat 36, and an expanded form as shown when being used for swimming.

The fin blade 26 further comprises a means at its tip end to releasably interconnect with said securement means 24 such that one or more such swim fins may be interconnected to form a belt that can be worn by the user when said swim fins are in a collapsed state and not being used for swimming According to the embodiment shown, such means to releasably interconnect and secure said fins may comprise slots, depicted by numeral 28 in FIG. 1A, formed within the tip end of fin blade 26 to receive the strap of a second fin 10.

Side edges of the fin blade 26 may be fabricated from a rigid material while the interior portion of said fin blade may be fabricated from a flexible material. In this manner, the fin blade can preserve its integrity both while in use as well as when not in use. Further, the fin blade 26 may also comprise a strut, along one or both edges to bolster its structure. The strut may be fabricated from any rigid material including, without limitation, fiberglass, carbon-fiber, plastic and composites.

The swim fin 10 also comprises adjustable straps 30 that form an aspect of foot enclosure 22 and which are used to support and tighten the fin around a user's foot in a snug manner. In the embodiment shown in FIG. 1A, two such straps 30 are shown to enable the tightening, however, one skilled in the art will understand that even one strap or three straps can also be made to work, if necessary. The straps 30 are configured to go through slots made available on the top and the sides and then under the user's foot. Other suitable locations for the placement of the slots to achieve the purposes of securing the fin blade around a user's foot while leaving the fin suitable for folding into a flat form will become obvious to one skilled in the art, and are all encompassed to be within the scope of the invention. Accordingly, the length and width of the slots will also vary, which can be arrived at without undue experimentation. Similarly, the length, width and strengths of the straps may be varied depending upon the duty requirements.

Figure 1B:
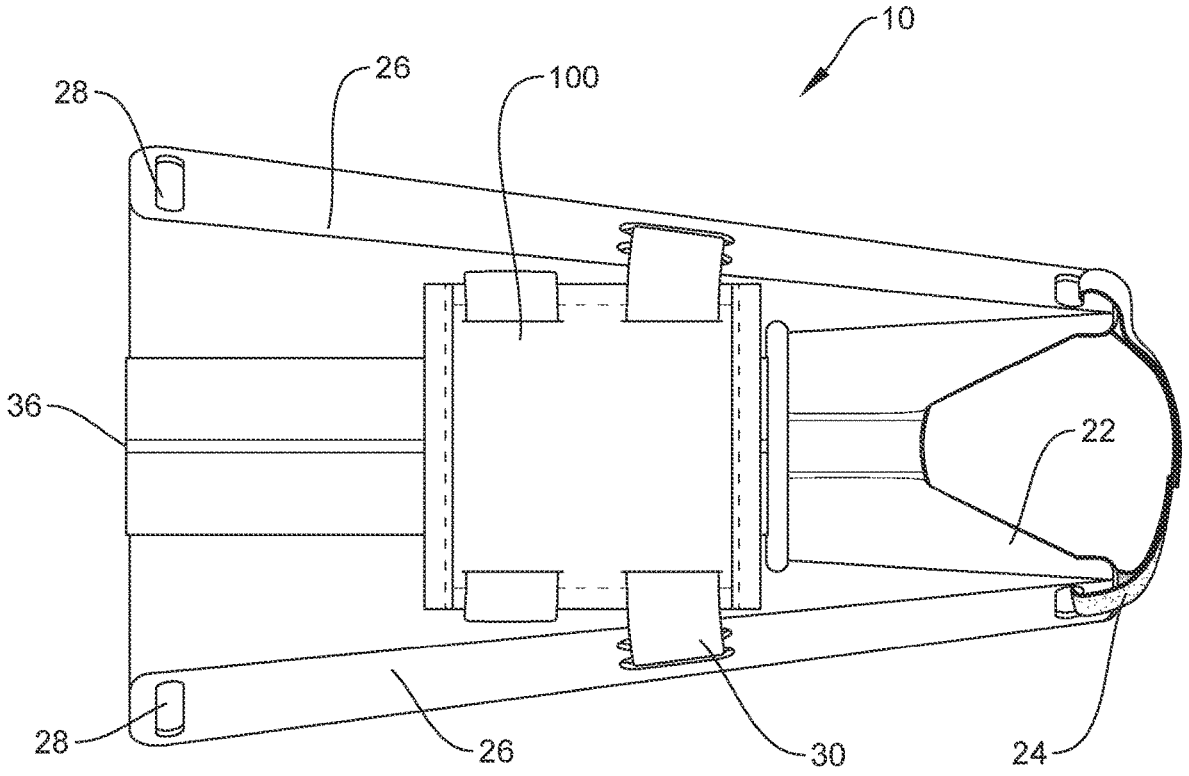
FIG. 1B is a bottom view of the swim fin of the preferred embodiment invention 10.

FIG. 1B is a bottom view of the swim fin of the invention 10, wherein a foot hammock 100 is made available to receive the user's foot within which the foot can be rested comfortably and supported within fin 10. The straps 30 are configured to go through foot hammock 100 via a number of slots. The tightening portion of the straps is conveniently provided on the top as shown in FIG. 1A so it can be easily accessed by the user. The foot hammock 100 can be made of a suitable flexible material configured to receive and handle the weight of the foot, and also be water resistant. It may include flexible plastic, nylon mesh, fabric, and so on. In one embodiment, foot hammock 100 is comprised of a rigid material sandwiched within a flexible material such as Cordura, neoprene, and rubber.

Figure 1C:
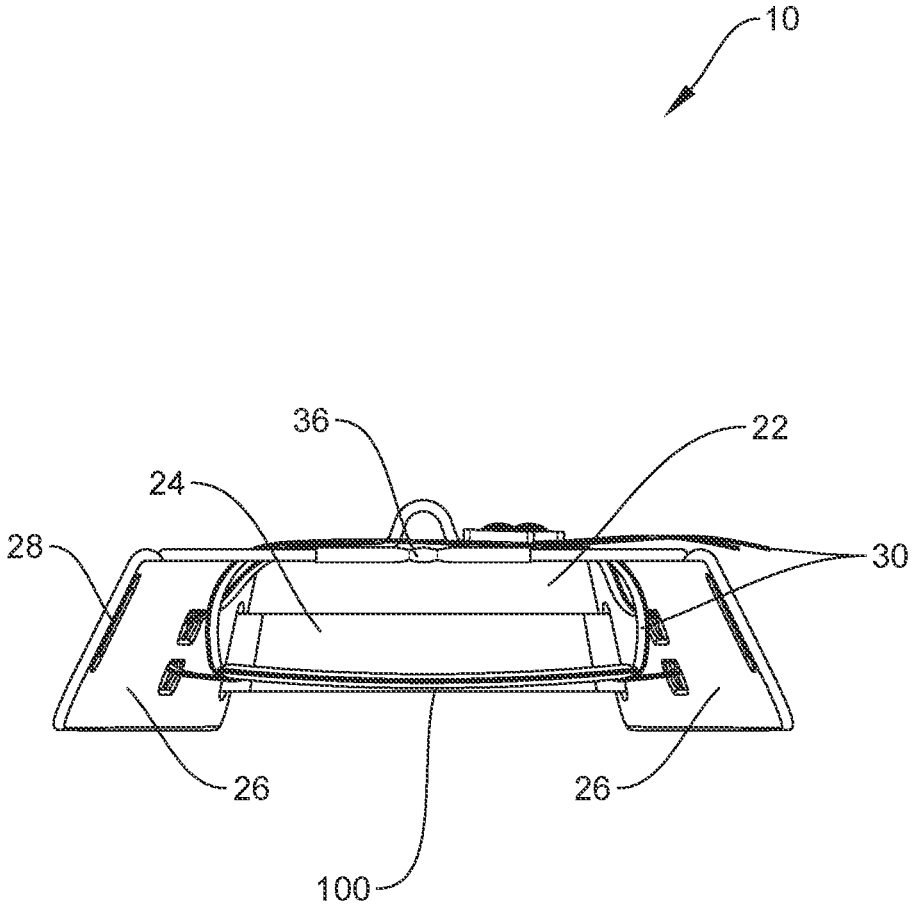
FIG. 1C is a front view of the swim fin 10 of the invention.
Figure 1D:
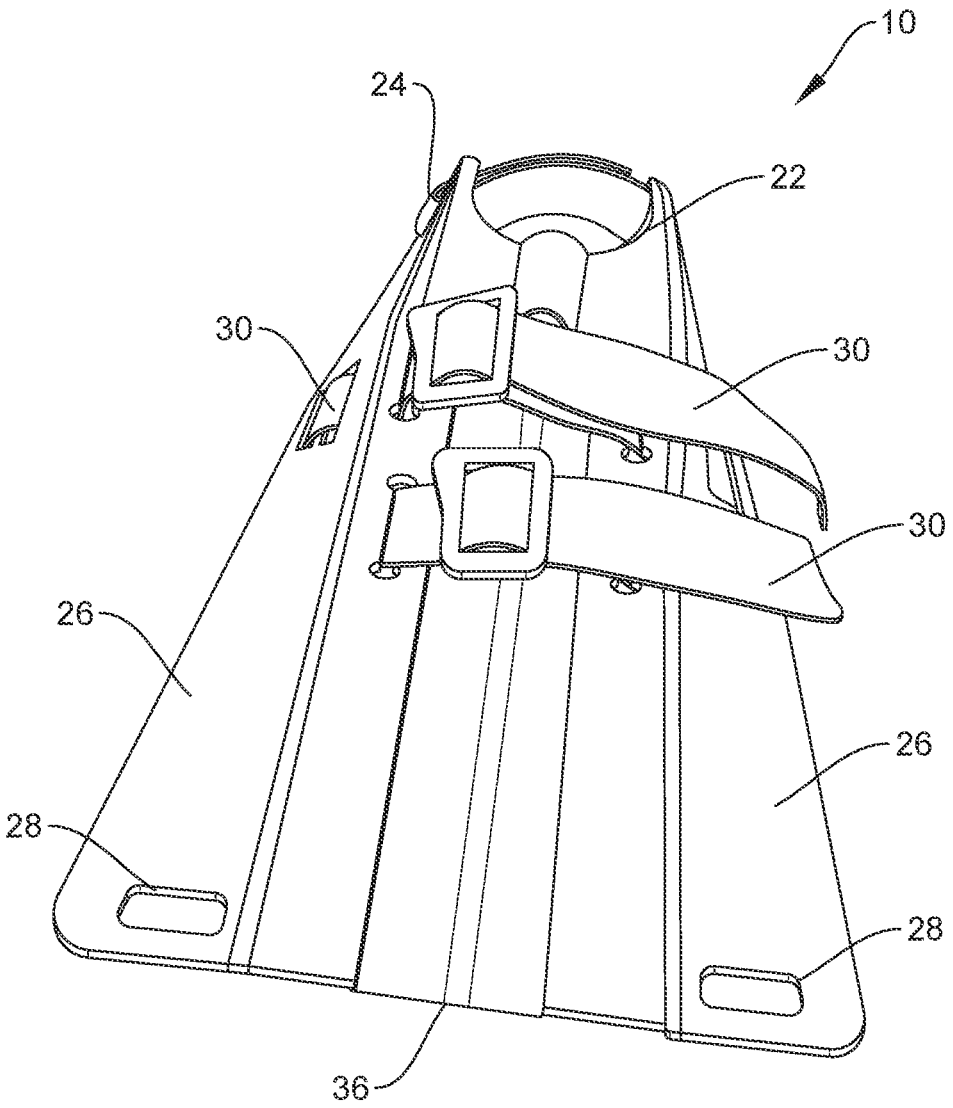
FIG. 1D is a front perspective view of the swim fin of the invention 10.

FIG. 1C is a front view of the swim fin 10 of the present invention. FIG. 1D is a top front perspective view of the swim fin 10 of the invention.

FIG. 2A is a side view of the swim fin 10 with a user's foot secured within foot enclosure 24 and resting on hammock 100. The user's foot is secured at the back of the foot by strap 24, and at the top of the foot by straps 30. FIG. 2B illustrates swim fin 10 with a user's foot inside the foot hammock 100 wherein the outside blade 26 is cutaway to show the manner in which foot hammock 100 encloses and supports a user's foot.

FIG. 3A is a top perspective view of the foot hammock 100 shown separately with the straps buckled for tightening purposes. FIG. 3B shows foot hammock 100 from the bottom with the straps 30 fully opened, while FIG. 3C is a top view of the foot hammock 100 with the straps 30 fully opened.

Shown in FIG. 4 is a top perspective view of a first alternate embodiment 10' of the swim fin 10 that comprising a heel cincture 16 in the heel pocket 12 that allows for the heel of a user to be secured within. According to the embodiment shown, swim fin 10' comprises a heal strap 24 and a single foot strap 30 that can be used with or without the foot hammock 100 shown with respect to the previous embodiment. The user can adjust the straps 24 and 30 suitably to ensure a snug fit around the foot.

As depicted in FIG. 4, heal strap 24 is releasably secured to heal end of blade 26 by threading strap 24 through slots formed within heal aspect of blade 26 and releasably attaching strap 26 to itself using, for example, Velcro 14. Alternative embodiment fin 10' includes three pleats 36 compared to the one pleat 36 shown with respect to the first embodiment fin 10. Swim fin 10' is collapsed flat by folding along pleats 36 when not in use.

In a preferred embodiment, each fin blade 26 demonstrate a slot 28 near the blade tip. Slots 28 may be formed in each individual fin blade 26 or across more than one fin blade 26 as shown in FIG. 4. In either case, slots 28 are configured such that line up exactly against each other when fin 10' is in the collapsed state. The configuration of the straps 24 and 30 may be as already described herein, comprising a buckle or interlocking fibers or other such known means to fasten the two ends of the strap.

FIG. 5 is a side perspective view of yet another alternate embodiment 10" of the swim fin of the subject wherein it comprises multiple pleats 36 along which fin 10" can be folded. Here alternative embodiment swim fin 10" is shown a partially folded state, with slots 28, each formed within the tip of each fin blade 26, aligned to receive the heal strap 24 of another fin (as shown in FIGS. 7A, 7B and 8).

A further alternative embodiment 10''' of swim fin 10 is illustrated from the top in FIGS. 6A and 6B. FIG. 6A shows swim fin 10''' in expanded state for swimming, while FIG. 6B shows swim fin 10''' fully folded for storage and carriage. Slits 20 are formed in outside blades 26 to receive foot strap 30. Strap 30 is tightened around the foot when in use, and can be tightened using a buckle or other such securement means when not in use as shown in FIG. 6B to ensure swim fin 10''' remains in a folded state while being stored or carried.

FIG. 7A is a top view of two swim fins 10 of the subject invention attached to each other, such that heal strap 24 of a first swim fin 10*a* is looped through the slots 28 of a second fin 10*b*. In FIG. 7B, first swim fin 10*a*, shown in a partially folded state, has its heal strap 24 looped through slots 28 of second swim fin 10*b*, shown in a completely folded state, with heel strap 24 then secured back onto itself connecting fin 10*a* and fin 10*b* one to the other at one end.

FIG. 8 illustrates the belt structure formed when two swim fins 10 of the present invention are secured to one another using heal strap 24 that are passed through fin blade slots 28 and then is secured to itself. Swim fins 10 with fin blades 26 are fabricated using materials and methods that leave it with sufficient flexibility such that, once folded and interconnected as shown in FIG. 8, it retains the ability to form a loop or belt structure enabling the interconnected swim fins be used in a number of different ways. For example, in FIG. 9, a pair of swim fins 10 of the subject invention is worn around a person's waist as a belt, while in FIG. 10, a pair of swim fins 10 of the subject invention is worn around a person's shoulder like a bandolier.

When the fins are needed, the belt form of swim fins 10 can be quickly converted into individual fins 10 by releasing heal straps 24 and expanding blades 26 along pleats 36 from a folded or collapsed form to an expanded to extended form, thus rendering the fins capable of receiving feet. Once the feet are inserted, heal straps 24 and foot straps 30 can then be tightened around the user's foot, rendering the fins ready to assist the user to swim. Fins 10, while flexible when folded and interconnected to form a belt structure, demonstrates increased rigidity when expanded with foot inserted. This rigidity allows the fin to develop significant force propelling the swimmer through the water.

The rigidity of the deployed fins is achieved in a number of ways. For example, fin 10 can be made rigid by including rigid struts for the outside blades 26. Swim fin 10 can also be made rigid in deployed form by tightening foot straps 30 around the foot of the user.

Fins 10 in a collapsed and interconnected state, as shown in FIG. 8, are easily further compressed into a flat form for ease of storage. Fins 10 folded and compressed flat, can be stored in wide variety of form and manners. So, for example, for those not wanting to wear fins 10 as a belt or bandolier, the fins can be stored and carried on one's person in a fanny pack, bag or other carrying means. The flattened, compressed form of fins 10 is also ideal for storage in small places in a compact manner such that fins 10 may be attached to flotation devices such as safe jackets whether stowed on board or worn during on-water activities. The small footprint of the folded and compressed swim fins renders them suitable for inclusion in large quantities on a variety of vessels. They can easily be included, for example, in a Pelican case used to stow water safety equipment on recreational or commercial vessels.

While fins 10 can be fabricated from a variety of rigid and flexible material as explained above. Preferably, fins 10 are fabricated from all recycled materials thereby optimizing the sustainability of the fabrication materials while safeguard the environment.

The invention allows users to have fins on when needed but stowed and carried in a way that the activity the user is participating in is not impeded in any way.

Similarly, when the user is done using the swim fins, they can be packed by simply folding along the pleats and secured using the securement means. This can be achieved in a very rapid and facile manner. Further, the ability of the user to secure a pair of swim fins to each other and be able to wear it like a belt or a bandolier, or stored within a fanny pack or other storage facility, provides a significant advantage over all existing swim fins.

SUMMARY AND SCOPE

Thus, the swim fins of the invention present represent a significant advantage over existing swim fins in that they allow for ease of packing to transport and store when not in use, while also ensuring simplicity of deploying the fins for use. The combination swim fin belt apparatus is capable of being transported by the user without interference while involved in other activities.

The fin belt can be made in different sizes or size ranges, such as small, medium, large, extra-large etc., as well as children and adult sizes, to accommodate different sized feet. Additionally, the type, size and strength of fabrication materials can be selected to address different duty requirements. Further, it will also become apparent to one of ordinary skill in the art to link more than two collapsible fins in a loop to form larger belt shaped structures. Other such variations for storing and carrying will become apparent to one skilled in the art, and is envisioned to be encompassed within the scope of the invention.

Examples of the novel utility of the swim fins and the combination swim fin belt apparatus comprising the swim fins of the subject invention include, but are not limited to:

- Big wave surfers and surfers surfing far from shore who wants some insurance in the case of a broken surf leash or broken surf board;
- Shore fisherman fishing off of precarious rock ledges and/or near large surf;
- Surf fisherman who wades too far out and get pulled off the sandbar or reef by rip currents;
- Offshore OC 1, 2, 4 or 6 racers who experience structural issues or gets separated from their craft far from shore;
- Offshore SUP paddlers, wind surfers, kite surfers, ocean kayakers, kayak fisherman, etc. who become separated from their board or vessel;
- High risk jobs on large ships;
- High risk jobs on wharfs;
- Coastal authorities, lifeguards, police, etc.;
- Military (helicopter pilots, misc. naval uses etc.);
- Travelers who want to carry a compact set of their own fins that already fit them rather than buying or renting fins at the travel destination;
- Fly fisherman who use belly boats (float tubes);
- Commercial fisherman, particularly on especially rough days;
- Backpackers hiking near bodies of water;
- Whitewater adventure activities such as kayaking and rafting;
- Commercial fisherman, particularly on especially rough days; Pleasure watercraft including sailboats, rowboats and dinghies.
- General water transport including, for example, ferries, cruise ships, passenger ships and freight ships;

While specific preferred embodiments and examples of collapsible fins and fin belt of the subject invention have been illustrated and described, it will be clear that the invention is not so limited. Numerous modifications or alterations, changes, variations, substitutions and equivalents will occur to those skilled in the art without deviating from the spirit and scope of the invention, and are deemed part and parcel of the invention disclosed herein. By way of example and not limitation, the fin belt can be fabricated from a variety of original and recycled materials using different fabrication methods; a variety of known closure methods can be suitably used; the number of pleats can be varied, the size and shape of the fin blade tip openings can be varied, dimensions can be modified as can the manner of reinforcing the fin pleats, in accordance with the general principles of the invention as described herein in order to accommodate different working conditions, target materials, project specification, budgetary considerations and user preferences. The invention described herein is inclusive of all such modifications and variations.

I claim:

1. A swim fin comprising:

a collapsible swim fin blade that demonstrates an expanded form when being used for swimming and a substantially flat form when not being used for swimming, said fin blade having a heal aspect opposite a tip aspect;

a collapsible foot enclosure formed within the heal aspect of said swim blade to receive the foot of a user when being used for swimming and demonstrating a substantially flat form when not being used for swimming;

a means for releasably securing the heal aspect of the fin blade of one such swim fin to the tip aspect of the fin blade of a second such swim fin to form a loop structure in which the tip aspect of one swim fin substantially abuts the heal aspect of the second swim fin and the tip aspect of the second swim fin substantially abuts the heal aspect of the first swim fin, that can be worn by the user as a belt or stored in flat form when said swim fins are in a collapsed substantially flat form and not being used for swimming.

2. The swim fin of claim 1 wherein said fin blade is made collapsible by means of one or more pleats formed along the length of said fin blade.

3. The swim fin of claim 1 wherein said foot enclosure substantially encloses the foot.

4. The swim fin of claim 1 wherein said foot enclosure comprises one or more cinctures that encircle the foot.

5. The swim fin of claim 4 further comprising a platform attached by said cinctures that underlies and supports the foot within said foot enclosure.

6. The swim fin of claim 1 wherein said foot enclosure comprises a length adjustable heal strap that secures the heal of the user within said foot enclosure.

7. A swim fin comprising:

a collapsible swim fin blade that demonstrates an expanded form when being used for swimming and a substantially flat form when not being used for swimming, said fin blade having a heal aspect opposite a tip aspect;

a collapsible foot enclosure formed within the heal aspect of said swim blade to receive the foot of a user when being used for swimming and demonstrating a substantially flat form when not being used for swimming;

comprises a heal strap with securement means extending from heal aspect of said fin blade that is received by and releasably secured to one or more slots formed within the tip aspect of said fin blade to form a loop structure that can be worn by the user as a belt or stored in flat form when said swim fins are in a collapsed substantially flat form and not being used for swimming.

8. The swim fin of claim 1 wherein said foot enclosure further comprises a collapsible heel pocket that extends out from the bottom of the heal aspect of said fin blade.

9. The swim fin of claim 1 wherein the sides of said fin blade are fabricated from rigid material and the interior of said fin blade is fabricated from flexible material.

10. The swim fin of claim 1 wherein said swim fin blade further comprises a strut along one or both side edges.

11. The swim fin of claim 6 wherein said heal strap further comprising padding on its inside facing surface for comfort when said fin is being used for swimming.

12. The swim fin of claim 6 wherein said strap is made length adjustable by means of at least one of a clip, buckle, interlocking fibers or combinations thereof.

13. A combination swim fin belt apparatus comprising:

a foot housing with blade configured to be collapsed into a substantially flat form when not being used for swimming;

a securement means integrated with said foot housing for releasably securing the foot of a user within said housing when said apparatus is being used for swimming; and a means for releasably securing said rear of the foot housing of one such swim fin to the tip of the blade a second such swim fin;

such that the swim fins may be chained together with the blade tip of one swim fin substantially abutting the rear foot housing of the second swim fin and the blade tip of the second swim fin substantially abutting the rear foot housing of the first swim fin to form a belt that can be worn by a user when said swim fins are collapsed and not being used for swimming.

14. The apparatus of claim 13 wherein said foot housing with blade is made collapsible by means of foldable pleats formed along the length of said housing and blade.

15. The apparatus of claim 13 wherein said foot housing substantially encloses the foot.

16. The apparatus of claim 13 wherein said foot housing comprises one or more cinctures that encircle the foot.

17. The apparatus of claim 16 further comprising a platform attached by said cinctures that underlies and supports the foot within said foot housing.

18. The apparatus of claim 13 wherein said means for releasably securing the rear of said foot housing of one such swim fin to the tip of the blade a second such swim fin comprises a length adjustable heal strap extending from the rear of the foot housing of the first swim fin that is received by and releasably secured to one or more slots formed within the blade tips of the second swim fin.

19. The apparatus of claim 13 wherein the outside edges of said blade are fabricated from rigid material and the interior portion of the blade is fabricated from flexible material.

20. The apparatus of claim 13 further comprising rigid struts formed along one or both sides of said blade.

* * * * *